US010845743B2

(12) United States Patent
Abe et al.

(10) Patent No.: US 10,845,743 B2
(45) Date of Patent: Nov. 24, 2020

(54) ELECTROPHOTOGRAPHIC MEMBER AND FIXING DEVICE

(71) Applicant: CANON KABUSHIKI KAISHA, Tokyo (JP)

(72) Inventors: Katsuya Abe, Tokyo (JP); Katsuhisa Matsunaka, Inagi (JP); Kazuo Kishino, Yokohama (JP); Matsutaka Maeda, Kawasaki (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/593,797

(22) Filed: Oct. 4, 2019

(65) Prior Publication Data

US 2020/0117127 A1 Apr. 16, 2020

(30) Foreign Application Priority Data

Oct. 10, 2018 (JP) ..... 2018-192013
Sep. 19, 2019 (JP) ..... 2019-170309

(51) Int. Cl.
*G03G 15/20* (2006.01)

(52) U.S. Cl.
CPC ..... *G03G 15/2057* (2013.01); *G03G 15/206* (2013.01); *G03G 15/2064* (2013.01); *G03G 2215/00957* (2013.01); *G03G 2215/2035* (2013.01); *G03G 2215/2051* (2013.01)

(58) Field of Classification Search
CPC ..... G03G 15/2057; G03G 15/2064; G03G 15/206; G03G 2215/2035; G03G 2215/2051; G03G 15/162; G03G 15/1685; G03G 2215/00957
See application file for complete search history.

(56) References Cited

U.S. PATENT DOCUMENTS

2014/0348559 A1* 11/2014 Miyahara ..... B32B 7/00 399/333
2018/0032004 A1* 2/2018 Miyahara ..... G03G 15/206
2019/0302658 A1* 10/2019 Hayashi ..... G03G 21/1814

FOREIGN PATENT DOCUMENTS

JP H04-139258 A 5/1992
JP 2001-172568 A 6/2001
JP 2005156856 A * 6/2005
(Continued)

*Primary Examiner* — Walter L Lindsay, Jr.
*Assistant Examiner* — Laura Roth
(74) *Attorney, Agent, or Firm* — Canon U.S.A., Inc. IP Division

(57) ABSTRACT

An electrophotographic member including: a base member; an elastic layer having a thickness of from 100 μm to 500 μm, and containing a cured product of an addition-curable silicone rubber composition; and a cured product layer arranged between the base member and the elastic layer, the cured product layer containing a cured product of a composition containing an organopolysiloxane having a Si—H group and a silane coupling agent having an alkenyl group. A peel adhesive strength between the elastic layer and the base member is a specific range. The elastic layer undergoes a cohesive failure in a peel test from the base member. The ratio (HU2/HU1) of a universal hardness HU2 on the inner surface of the elastic layer to a universal hardness HU1 at a position reached by cutting the elastic layer from its outer surface in its depth direction by 10 μm is a specific range.

12 Claims, 5 Drawing Sheets

(56) References Cited

FOREIGN PATENT DOCUMENTS

| | | | |
|---|---|---|---|
| JP | 2015-110216 | A | 6/2015 |
| JP | 6066011 | B1 | 1/2017 |
| JP | 2018-72519 | A | 5/2018 |

* cited by examiner

ELECTROPHOTOGRAPHIC MEMBER AND FIXING DEVICE

The present disclosure relates to an electrophotographic member and a fixing device to be used in an electrophotographic apparatus.

Description of the Related Art

In the fixation of an unfixed toner image to a recording material in an electrophotographic apparatus, a fixing device including two members arranged opposite to each other for pressing the unfixed toner image that has been heated against the recording material has been used.

A form in accordance with a fixing system, such as the combination of a pair of rollers, the combination of a film and a roller, the combination of a belt and another belt, or the combination of a belt and a roller, has been used as the combination of the two opposing members in the fixing device. Those members are included in an electrophotographic member, and a member in contact with unfixed toner is also referred to as "fixing member". The fixing member includes a fixing roller, a film-shaped member, and a fixing belt in accordance with its form. Meanwhile, a member that is arranged opposite to the fixing member and forms a fixing nip together with the fixing member is also referred to as "pressure member". The pressure member includes a pressure roller, a pressure film, and a pressure belt in accordance with its form.

In Japanese Patent No. 6066011, there is a disclosure of a rotating member to be used as a fixing member obtained by arranging an elastic layer on a tubular base member. The rotating member includes, between the base member and the elastic layer, a layer that is a cured product of a composition containing a siloxane oligomer having a Si—H group, a silane coupling agent having an alkenyl group, and a tetraalkoxysilane. In addition, in Japanese Patent No. 6066011, there is a description that, when such layer of the cured product (hereinafter sometimes simply referred to as "cured product layer") is arranged, the hardness of the inner peripheral surface of the elastic layer is set to be 15 or more times as high as that of the outer peripheral surface thereof, and hence the uplift of the outer peripheral surface resulting from the peeling of the elastic layer from the base member can be suppressed.

According to our investigation, when a toner image is formed on thick paper thicker than plain paper by using the rotating member according to Japanese Patent No. 6066011 as a fixing belt for heating unfixed toner, breakage may occur in the elastic layer of the rotating member.

SUMMARY OF THE INVENTION

At least one embodiment of the present disclosure is directed to providing an electrophotographic member that can prevent the occurrence of the breakage of an elastic layer when the fixing of an electrophotographic image to a thick recording material is repeated. At least another embodiment of the present disclosure is directed to providing a fixing device that can stably form a high-quality electrophotographic image.

According to at least one embodiment of the present disclosure, there is provided an electrophotographic member including: a base member; a cured product layer; and an elastic layer, in this order, the elastic layer having a thickness of 100 μm or more to 500 μm or less, and containing a cured product of an addition-curable silicone rubber composition, the cured product layer being in contact with the base member and an inner surface of the elastic layer, the cured product layer containing a cured product of a composition containing an organopolysiloxane having a Si—H group and a silane coupling agent having an alkenyl group, wherein a peel adhesive strength between the elastic layer and the base member is 3.0 N/cm or more to 20.0 N/cm or less, wherein the elastic layer undergoes a cohesive failure in a peel test from the base member, and wherein, when a universal hardness of the elastic layer in a thickness direction thereof measured at a position reached by cutting the elastic layer from an outer surface thereof in a depth direction thereof by 10 μm is represented by HU1, and a universal hardness of the elastic layer in the thickness direction measured on the inner surface of the elastic layer is represented by HU2, a ratio HU2/HU1 is 1.0 or more to 1.4 or less.

According to at least one embodiment of the present disclosure, there is provided a fixing device including a fixing member; and a pressure member, the fixing device being configured to heat a recording material having an unfixed toner image in a nip portion formed by the fixing member and the pressure member to fix the unfixed toner image to the recording material, wherein the fixing member includes the electrophotographic member.

Further features of the present disclosure will become apparent from the following description of exemplary embodiments with reference to the attached drawings.

DESCRIPTION OF THE EMBODIMENTS

Figure 1A:
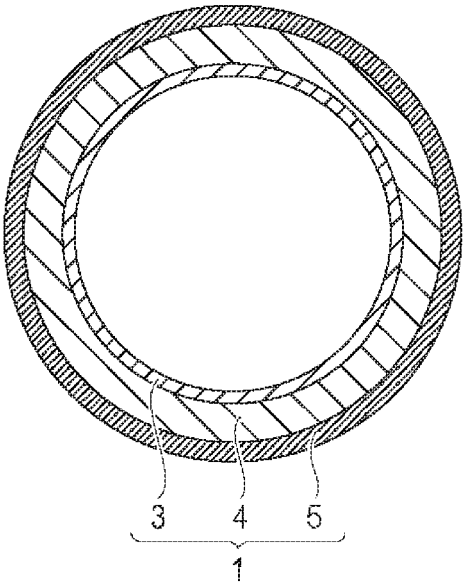
FIG. 1A is a schematic sectional view for illustrating an electrophotographic member according to at least one embodiment of the present disclosure.

We have assumed that the reason why breakage occurs in the elastic layer of the rotating member according to Japanese Patent No. 6066011 results from the fact that a difference in hardness between the inner peripheral surface side and outer peripheral surface side of the elastic layer is large. That is, it is assumed that, when thick paper is introduced into a nip portion formed by the rotating member and a pressure member for fixing unfixed toner onto the thick paper, the elastic layer of the rotating member undergoes a compressive deformation, and at this time, a stress concentrates on the portion of the elastic layer where the hardness difference is large to cause the breakage in the elastic layer.

Breakage has been liable to occur particularly in the elastic layer present in a boundary portion between a region with which the thick paper is in contact (hereinafter sometimes referred to as "paper-passing region") and an end portion region with which the thick paper is out of contact (hereinafter sometimes referred to as "non-paper-passing region") in a direction perpendicular to the peripheral direction of the rotating member. This is probably because, in the boundary portion between the paper-passing region where the deformation amount of the elastic layer is large and the non-paper-passing region where the deformation amount is small, a stress is liable to concentrate particularly on the portion of the elastic layer where the hardness difference is large.

Specifically, while plain paper having a basis weight of from about 60 $g/m^2$ to about 90 $g/m^2$ generally has a thickness of from about 80 μm to about 120 μm, printing paper having a basis weight of from about 100 $g/m^2$ to about 400 $g/m^2$, which is referred to as "thick paper", generally has a thickness of from about 150 μm to about 300 μm. Accordingly, when the thick paper is passed, an elastic layer in an electrophotographic member deforms to a larger extent to absorb its thickness. In the vicinity of a paper end portion at the time of the passing of the thick paper, however, a region where the paper is present and a region where the paper is absent largely differ from each other in deformation amount, and hence large strain occurs in the elastic layer; particularly when the hardness of the layer is high in the vicinity of the inner peripheral surface thereof, a stress concentrates thereon.

In view of the foregoing, we have made an investigation for the prevention of the occurrence of a large hardness difference in the thickness direction of the elastic layer. Herein, a possible reason for the high hardness of the inner peripheral surface of the elastic layer in the rotating member according to Japanese Patent No. 6066011 is as follows: at the time of the formation of the elastic layer on the cured product layer, an organopolysiloxane having a hydrosilyl group (hereinafter sometimes referred to as "Si—H group"), which serves as one material for forming the cured product layer, penetrates into the layer of a material for forming the elastic layer to be formed on the cured product layer to react with an alkenyl group in the material for forming the elastic layer, thereby locally increasing a hardness on the side of the elastic layer close to the cured product layer.

In view of the foregoing, with a view to reducing the penetration amount of the organopolysiloxane having a Si—H group, which is remained unreacted in the cured product layer, from the cured product layer into the layer of the material for forming the elastic layer, we have made an investigation on a reduction in amount of the organopolysiloxane to be blended into a material for forming the cured product layer. As a result, however, an adhesive force between the base member and the elastic layer has reduced in some cases. That is, an improvement in adhesive force between the base member and the elastic layer via the cured product layer is based on such reaction schemes as illustrated in FIG. 2A to FIG. 2C.

Figure 2A:
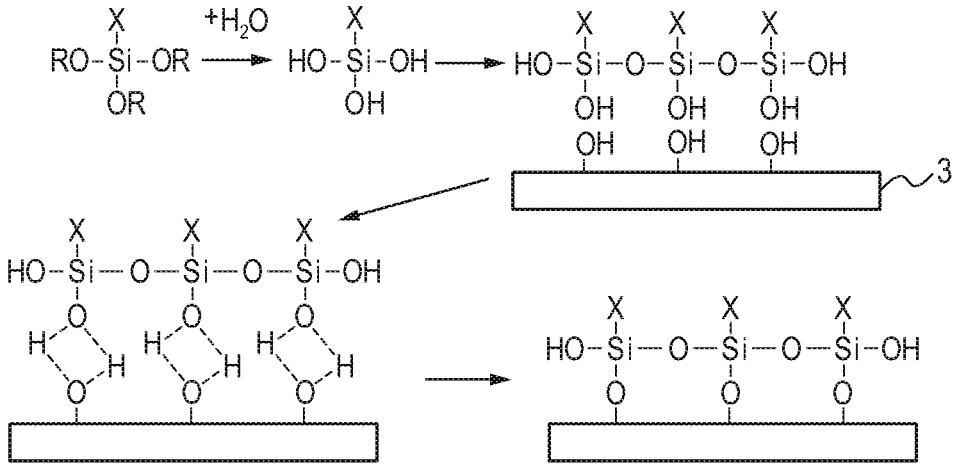
FIG. 2A is a view for describing a reaction between a primer and an addition-curable silicone rubber composition in the electrophotographic member according to at least one embodiment of the present disclosure.

When the material for forming the cured product layer is applied onto the surface of a base member 3, as illustrated in FIG. 2A, a hydroxy group present on the outer surface of the base member 3 and a hydroxy group of the silane coupling agent react with each other to fix a group X containing an alkenyl group onto the outer surface of the base member. Herein, the group X containing the alkenyl group is, for example, $—(CH_2)_3—O—C(=O)—C(CH_3)=CH_2$ as illustrated in FIG. 2B.

Figure 2B:
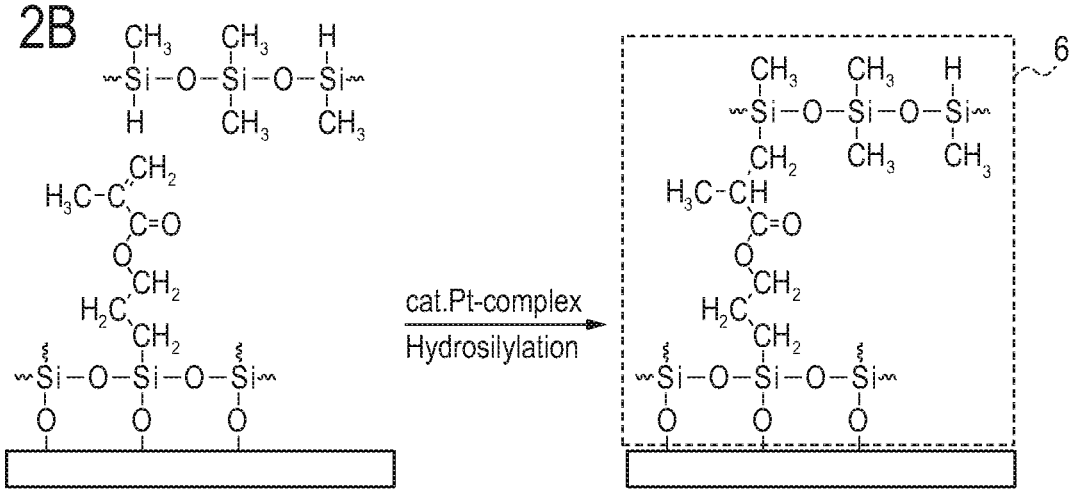
FIG. 2B is a view for describing the reaction between the primer and the addition-curable silicone rubber composition in the electrophotographic member according to at least one embodiment of the present disclosure.
Figure 2C:
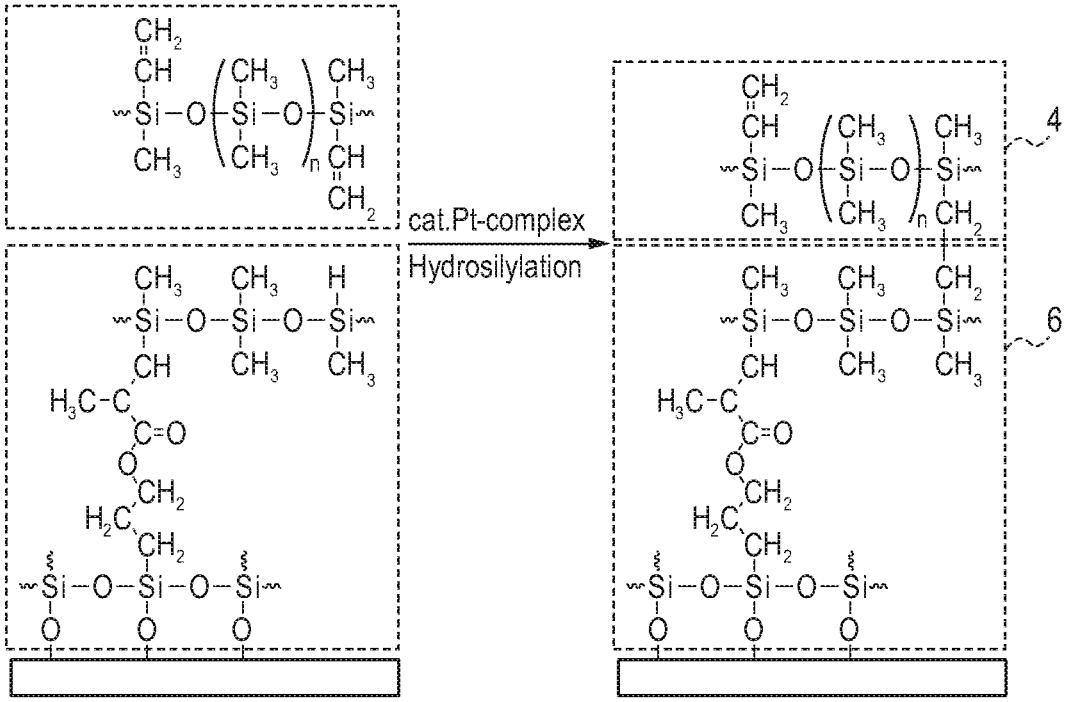
FIG. 2C is a view for describing the reaction between the primer and the addition-curable silicone rubber composition in the electrophotographic member according to at least one embodiment of the present disclosure.

Next, as illustrated in FIG. 2B, the alkenyl group in the group X containing the alkenyl group reacts with a Si—H group in the organopolysiloxane (hydrosilylation reaction (hydrosilylation)), to form a cured product layer 6. Here, a part of the Si—H group in the organopolysiloxane is not reacted with an alkenyl group, and present in a state that is bonded on an outer surface of the cured product layer 6 as shown in FIG. 2B. Next, as illustrated in FIG. 2C, the layer of an addition-curable liquid silicone rubber mixture serving as a material for forming the elastic layer is formed on the cured product layer 6, and is cured to form an elastic layer 4. In the process of forming the elastic layer 4, a part of the organopolysiloxane having an alkenyl group contained in the material for forming the elastic layer is reacted with the Si—H group bonded on the outer surface of the cured product layer 6, and chemical bond is created at an interface between the cured product layer 6 and the elastic layer 4. As a result of that, the adhesive strength between the base member and the elastic layer is increased.

In the rotating member according to Japanese Patent No. 6066011, in a formation process for the elastic layer 4 through the curing of the layer of the addition-curable liquid silicone rubber mixture for forming the elastic layer, the siloxane oligomer having an unreacted Si—H group in the cured product layer 6 may penetrate into the layer of the addition-curable liquid silicone rubber mixture serving as a material for forming the elastic layer to increase a hardness on the side of the elastic layer opposite to the cured product layer.

The above-mentioned attempt to reduce the amount of the organopolysiloxane to be blended into the material for forming the cured product layer has reduced the efficiency of the reaction between the group X containing the alkenyl group and the siloxane oligomer illustrated in FIG. 2B, and probably as a result of the foregoing, the adhesive force between the base member and the elastic layer has reduced.

In view of the foregoing, we have obtained the following finding: the suppression of the occurrence of breakage in the elastic layer at the time of the heat fixation of unfixed toner onto thick paper requires the development of a new technology for preventing an increase in hardness on the base member side of the elastic layer while maintaining the adhesive force between the base member and the elastic layer.

We have made further investigations in view of the finding, and as a result, have found that the following approach is effective in suppressing an increase in hardness on the inner peripheral surface side of the elastic layer without reducing the amount of the organopolysiloxane having a Si—H group to be blended into the material for forming the cured product layer: a reduction in amount of the organopolysiloxane, which is unreacted, remaining in the cured product layer after the formation of the cured product layer.

Examples of a method of reducing the amount of the organopolysiloxane, which is unreacted, remaining in the cured product layer include the following methods (i) and (ii):

(i) a method involving increasing the reaction ratio of the organopolysiloxane in the layer of the material for forming the cured product layer with an alkenyl group to reduce the amount of the organopolysiloxane remained unreacted in the cured product layer; (ii) a method involving removing the organopolysiloxane from the cured product layer after the formation of the cured product layer to reduce the amount of the organopolysiloxane remained unreacted in the cured product layer.

First, a specific method of the method (i) is given.

(a) The material for forming the cured product layer contains, as essential components, the organopolysiloxane having a Si—H group, and the silane coupling agent having an alkenyl group and a hydrolyzable functional group. A hydrolyzable functional group in the silane coupling agent is changed into a hydroxy group by hydrolysis, and a condensation reaction occurs between the hydroxy group and a hydroxy group on the surface of the base member. Thus, an alkenyl group is chemically fixed to the outer surface of the base member (see FIG. 2A and FIG. 2B).

Therefore, a catalyst configured to accelerate a condensation reaction (hereinafter also referred to as "a condensation catalyst") is used in a mixture containing such silane coupling agent. Meanwhile, in the coexistence of such condensation catalyst and a catalyst configured to accelerate addition curing for accelerating hydrosilylation (hereinafter also referred to as "an addition curing catalyst"), such as platinum, an exchange reaction between ligands forming the respective catalysts occurs to reduce the catalytic activity of each of the catalysts. Accordingly, no catalyst other than the condensation catalyst is typically incorporated into the mixture containing the silane coupling agent.

However, our investigation has found that, even in the case where the condensation catalyst and the addition curing catalyst are caused to coexist in the mixture, when the mixture is used immediately after its preparation, a reduction in activity of the condensation catalyst can be suppressed, that is, both of a condensation reaction between a hydroxy group derived from the silane coupling agent and a hydroxy group on the surface of the base member, and an addition reaction between an alkenyl group chemically fixed to the surface of the base member by the condensation reaction and a Si—H group can be efficiently caused. As a result, the amount of the organopolysiloxane that is unreacted in the cured product layer can be reduced without any reduction in amount of the organopolysiloxane having a Si—H group in the mixture.

(b) In the case where the material for forming the cured product layer needs to be stored over a long time period, the coexistence of the condensation catalyst and the addition curing catalyst in the material for forming the cured product layer is not preferred. In this case, only the condensation catalyst is incorporated into the mixture, and first, the layer of the material for forming the cured product layer is formed on the outer surface of the base member to cause a condensation reaction between a hydroxy group of the base member and a hydroxy group derived from the silane coupling agent. Subsequently, a catalyst liquid containing the addition curing catalyst is applied onto the outer surface of the layer of the material for forming the cured product layer to cause the organopolysiloxane having a Si—H group in the layer of the material to react (hydrosilylation reaction) with an alkenyl group chemically fixed onto the base member. As a result, the remaining of the organopolysiloxane having an unreacted Si—H group in the layer of the material for forming the cured product layer can be suppressed by the action of the addition curing catalyst.

Next, the method (ii) is described.

When the amount of the organopolysiloxane having a Si—H group in the material for forming the cured product layer is not reduced, and no measures like the method (i) are taken, the organopolysiloxane having an unreacted Si—H group remains in the cured product layer. When the layer of the addition-curable silicone rubber mixture for forming the elastic layer is formed on the surface of such cured product layer, the organopolysiloxane in the cured product layer permeates the elastic layer to increase a hardness in a region on the cured product layer side of the elastic layer.

In view of the foregoing, the organopolysiloxane having an unreacted Si—H group in the cured product layer is removed before the formation of the layer of the addition-curable silicone rubber mixture for forming the elastic layer on the surface of the cured product layer. A method for the removal is, for example, a method involving washing the surface of the cured product layer with a solvent. Examples of the solvent include methyl ethyl ketone, ethanol, toluene, and hexane. Of those, methyl ethyl ketone and ethanol each have a high affinity for the organopolysiloxane having a Si—H group, and hence each have a high removing effect on the organopolysiloxane in the cured product layer. Accordingly, methyl ethyl ketone and ethanol are preferred because each of methyl ethyl ketone and ethanol can more reliably suppress an increase in hardness on the side of the elastic layer opposite to the cured product layer.

A mode in which an electrophotographic member according to at least one embodiment of the present disclosure is used as a fixing member using a base member having an outer peripheral surface is described below.

(Fixing Member)

Figure 1B:
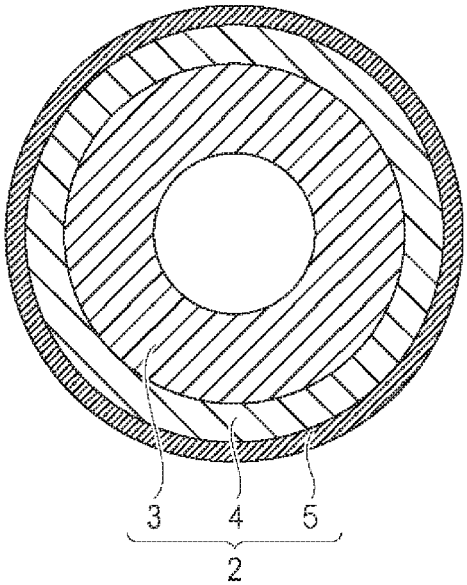
FIG. 1B is a schematic sectional view for illustrating the electrophotographic member according to at least one embodiment of the present disclosure.

FIG. 1A and FIG. 1B are schematic sectional views for illustrating the configurations of a fixing belt 1 and a fixing roller 2 each serving as the fixing member according to at least one embodiment of the present disclosure, respectively. The fixing belt 1 has an endless belt shape, and its base member itself deforms to form a fixing nip. The fixing roller 2 has a roller shape, and its base member itself is substantially free from deforming, but instead its elastic layer undergoes an elastic deformation to form a fixing nip.

The fixing belt 1 illustrated in FIG. 1A has a configuration in which the elastic layer 4 covers the cylindrical outer periphery of the base member 3, and a surface layer 5 covers the outer periphery of the elastic layer 4. A cured product layer (not shown) is present at an interface between the base member 3 and the elastic layer 4. The surface layer 5 may be fixed to the peripheral surface of the elastic layer 4 with an adhesion layer (not shown). In addition, the elastic layer 4 may include a plurality of layers. The fixing roller 2 illustrated in FIG. 1B has the same configuration. The fixing belt according to at least one embodiment of the present disclosure encompasses a film-shaped member.

The respective portions of the fixing member are described in detail below.

(Base Member)

As a material for the base member, a metal, such as aluminum, iron, stainless steel, or nickel, an alloy thereof, or a heat-resistant resin, such as polyimide, may be used. The base member may be formed by using those materials alone or in combination thereof.

When the fixing member has a roller shape, a cored bar is used as its base member. Examples of a material for the cored bar include metals and alloys, such as aluminum, iron, and stainless steel. The inside of the cored bar may be hollow as long as the cored bar has a strength enough to resist pressurization in a fixing device. When the inside of the cored bar is hollow, a heat source can be arranged in the cored bar.

When the fixing member has a belt shape, examples of its base member include an electroformed nickel sleeve, a stainless-steel sleeve, and a heat-resistant resin belt. A layer (not shown) for imparting a function, such as abrasion resistance or a heat-insulating property, may be further arranged on the inner surface of any such sleeve or belt. The surface of the base member may be subjected to a physical treatment, such as blasting, lapping, or polishing.

When the fixing member has a belt shape, the thickness of its base member is preferably 15 μm or more to 80 μm or less. When the fixing member has a roller shape and is hollow, the thickness of its base member is appropriately designed so that the deformation of the base member due to the pressing force of the fixing device may hardly occur.

(Elastic Layer)

The elastic layer contains a cured product of an addition-curable silicone rubber composition.

A composition known to be used for forming the elastic layer of an electrophotographic member, or a composition prepared by selecting a material that may be utilized for forming the elastic layer from known materials may be used as the addition-curable silicone rubber composition serving as a material for forming the elastic layer.

The cured product of the addition-curable silicone rubber composition imparts elasticity to the elastic layer.

The addition-curable silicone rubber composition may be obtained by kneading the following materials:

(a) an organopolysiloxane having an alkenyl group;

(b) an organopolysiloxane having a Si—H group; and (c) an addition curing catalyst.

Examples of the organopolysiloxane having an alkenyl group serving as the component (a) include the following organopolysiloxanes:

such a linear organopolysiloxane that both terminals of a molecule thereof are each represented by $R^1{}_2R^2SiO_{1/2}$, and the intermediate units of the molecule are represented by $R^1{}_2SiO$ and $R^1{}_2R^2SiO$; and such a branched organopolysiloxane that the terminals of a molecule thereof are each represented by $R^1{}_2R^2SiO_{1/2}$, and the intermediate units of the molecule include $R^1SiO_{3/2}$ and/or $SiO_{4/2}$.

Herein, $R^1$ represents a monovalent, unsubstituted or substituted hydrocarbon group that is bonded to a silicon atom and is free of any unsaturated aliphatic group. Specific examples thereof include: alkyl groups (e.g., alkyl groups each having 1 to 6 carbon atoms, such as a methyl group, an ethyl group, a n-propyl group, a n-butyl group, a n-pentyl group, and a n-hexyl group); aryl groups (e.g., a phenyl group and a naphthyl group); and substituted hydrocarbon groups (e.g., alkyl groups each having 1 to 3 carbon atoms and being substituted with a chlorine atom, a fluorine atom, or a cyano group, such as a chloromethyl group, a 3-chloropropyl group, a 3,3,3-trifluoropropyl group, a 3-cyanopropyl group, and a 3-methoxypropyl group).

In particular, it is preferred that 50% or more of all $R^1{}_s$ of the organopolysiloxane represent methyl groups because the organopolysiloxane is easy to synthesize and handle, and excellent heat resistance is obtained, and it is more preferred that all $R^1{}_s$ thereof represent methyl groups.

In addition, $R^2$ represents an alkenyl group bonded to a silicon atom. Examples of the alkenyl group represented by $R^2$ include a vinyl group, an allyl group, a 3-butenyl group, a 4-pentenyl group, and a 5-hexenyl group. Of those, a vinyl group is particularly preferred because the organopolysiloxane is easy to synthesize and handle, and the crosslinking reaction of the silicone rubber composition is easily performed.

The molecular weight of the organopolysiloxane having an alkenyl group serving as the component (a) is not particularly limited, and may be selected from the known molecular weights of organopolysiloxanes each having an alkenyl group to be used in the addition-curable silicone rubber composition for forming the elastic layer.

The organopolysiloxane having a Si—H group serving as the component (b) is a crosslinking agent configured to form a crosslinked structure through a reaction with an alkenyl group of the component (a) with the aid of the action of the addition curing catalyst, such as a platinum compound, serving as the component (c).

The number of Si—H groups in the component (b) is preferably a number of more than 3 on average in a molecule thereof. Examples of an organic group bonded to a silicon atom in the component (b) include the same unsubstituted or substituted, monovalent hydrocarbon groups as those each represented by $R^1$ of the organopolysiloxane component having an alkenyl group. Of those, a methyl group is particularly preferred because the organopolysiloxane is easy to synthesize and handle. The molecular weight of the organopolysiloxane having a Si—H group only needs to be selected from a range in which a target function as a crosslinking agent can be obtained, and hence the molecular weight is not particularly limited.

In addition, the viscosity of the component (b) at 25° C. falls within the range of preferably from 10 $mm^2/s$ or more to 100,000 $mm^2/s$ or less, more preferably from 15 $mm^2/s$ or more to 1,000 $mm^2/s$ or less. When the viscosity is 10 $mm^2/s$ or more, the organopolysiloxane hardly volatilizes during its storage, and hence a desired degree of crosslinking and desired physical properties can be obtained in the cured product to be obtained. In addition, when the viscosity is 100,000 $mm^2/s$ or less, the organopolysiloxane is easy to handle, and hence can be uniformly dispersed in a system with ease.

The siloxane skeleton of the component (b) may be any one of a linear skeleton, a branched skeleton, and a cyclic skeleton, and a mixture of two or more kinds of organosiloxanes having these skeletons may be used.

Of those, a linear skeleton is particularly preferred from the viewpoint of the ease with which the organopolysiloxane is synthesized.

In addition, in the component (b), Si—H groups may be present in any siloxane units in a molecule thereof, but at least part thereof are preferably present at a molecular terminal of the organopolysiloxane like an $R^1{}_2HSiO_{1/2}$ unit.

Further, the component (a) is preferably blended into the addition-curable silicone rubber composition so that the ratio of the number of alkenyl groups to the number of silicon atoms may be 0.001 or more to 0.020 or less, more preferably 0.002 or more to 0.010 or less. In addition, the component (b) is preferably blended so that the ratio of the number of Si—H groups to the number of alkenyl groups may be 0.3 or more to 1.0 or less. When the ratio of the number of Si—H groups to the number of alkenyl groups is 0.3 or more, a desired hardness can be stably obtained in a silicone rubber after curing. In addition, when the ratio of the number of Si—H groups to the number of alkenyl groups is 1.0 or less, an excessive increase in hardness of the silicone rubber can be suppressed. The ratio of the number of Si—H groups to the number of alkenyl groups may be calculated by determining the number of alkenyl groups and the number of Si—H groups through measurement involving using hydrogen nuclear magnetic resonance analysis ($^1$H-NMR (product name: JNM-AL400 FT-NMR; manufactured by JEOL Ltd.)).

Examples of the component (c) include known substances, such as a platinum compound and a rhodium compound.

In addition, the addition-curable silicone rubber composition may contain a reaction control agent (inhibitor) referred to as "inhibitor" in addition to the above-mentioned components (a) to (c). As the reaction control agent, a known substance, such as methylvinyltetrasiloxane, an acetylene alcohol, a siloxane-modified acetylene alcohol, or a hydroperoxide, may be used.

The blending ratios of the respective components for preparing the addition-curable silicone rubber composition only need to be set so that a target elastic layer may be obtained, and the ratios may be selected from known blending ratios.

(Filler)

A filler is preferably added to the elastic layer for imparting functions, such as thermal conductivity, heat resistance, and a reinforcing property, to the elastic layer. In addition, the filler is easily dispersed in the addition-curable silicone rubber composition. In addition, in accordance with the kind and addition amount of the filler, the degree of crosslinking of the cured product of the composition can be adjusted, and hence the elasticity of the elastic layer can be adjusted. Accordingly, the addition-curable silicone rubber composition is preferably used after the filler has been added thereto.

The filler preferably has thermal conductivity. Examples of the heat-conductive filler may include a metal, a metal compound, and a carbon fiber. A high heat-conductive filler is more preferred, and specific examples thereof include the following materials.

Silicon carbide (SiC), silicon nitride ($Si_3N_4$), boron nitride (BN), aluminum nitride (AlN), alumina ($Al_2O_3$), zinc oxide (ZnO), magnesium oxide (MgO), silica ($SiO_2$), copper (Cu), aluminum (Al), silver (Ag), iron (Fe), nickel (Ni), vapor grown carbon fibers, polyacrylonitrile (PAN)-based carbon fibers, and pitch-based carbon fibers.

Those fillers may be used alone or as a mixture thereof.

The average particle diameter of the filler is preferably 1 μm or more to 50 μm or less from the viewpoints of its handleability and dispersibility. In addition, a spherical shape, a pulverized shape, a needle shape, a plate shape, or a whisker shape is used as the shape of the filler. The filler is particularly preferably of a spherical shape from the viewpoint of its dispersibility.

The filler is preferably incorporated into the elastic layer at a content in the range of from 30 vol % or more to 60 vol % or less with respect to the total of the above-mentioned components (a), (b), and (c) in order that its function may be sufficiently achieved. At least one kind of a reinforcing filler, a heat-resistant filler, or a colored filler may be further added to the elastic layer.

(Formation of Elastic Layer)

The following method may be utilized in the formation of the elastic layer: the layer of the addition-curable silicone rubber composition is formed on the outer peripheral surface of the base member by a processing method, such as a die molding method, a blade coating method, a nozzle coating method, or a ring coating method, followed by heating. An adhesive property is imparted to the base member by a surface treatment with a primer liquid to be described later, and the treatment with the primer liquid is described in detail later.

The thickness of the elastic layer may be appropriately designed from the viewpoints of its contribution to the surface hardness of the fixing member and the securement of a nip width.

The thickness of the elastic layer in the fixing member according to this embodiment is 100 μm or more to 500 μm or less, preferably 200 μm or more to 400 μm or less. When the thickness of the elastic layer falls within the range, in the case where the fixing belt is incorporated into the fixing device, a sufficient nip width can be secured. In addition, when the thickness of the elastic layer falls within the range, in the case where a heat source is present in the belt, heat can be efficiently transferred from the heat source to a recording medium.

The strength of the elastic layer is generally as follows: a tensile strength (TS) measured with a dumbbell-shaped test piece No. 3 based on JIS K6251:2010 is preferably 0.4 MPa or more to 3.0 MPa or less, particularly preferably 1.0 MPa or more to 2.5 MPa or less. When the strength of the elastic layer falls within the range, the elastic layer of the fixing member can have a sufficient strength. The tensile strength of the elastic layer may be increased by increasing the degree of crosslinking of the organopolysiloxanes in the cured product forming the elastic layer. For example, the tensile strength of the elastic layer may be increased by increasing the ratio of the number of alkenyl groups to the number of silicon atoms, and the ratio of the number of active hydrogen groups (Si—H groups) to the number of silicon atoms.

(Method of measuring Universal Hardness of Elastic Layer)

A universal hardness (HU) is a hardness that may be measured with an ultramicrohardness meter (product name: FISCHERSCOPE HM2000 XYp; manufactured by Fischer Instruments K.K.), and a characteristic of a material may be evaluated based on the universal hardness. Portions where the universal hardnesses of the elastic layer in at least one embodiment of the present disclosure are measured are a position reached by cutting the elastic layer from its outer surface in its depth direction by 10 μm and the inner surface of the elastic layer, and the universal hardness of the elastic layer in its thickness direction is measured at each of the measurement positions.

A specific method of measuring the universal hardness is described in Example 1 to be described later. In at least one embodiment of the present disclosure, the ratio (HU2/HU1) of the universal hardness (HU2) measured on the inner surface of the elastic layer to the universal hardness (HU1) measured at the position reached by cutting the elastic layer from its outer surface in its depth direction by 10 μm is set to 1.0 or more to 1.4 or less, preferably 1.0 or more to 1.3 or less.

(Surface Layer)

A surface layer is formed on the surface of the fixing member as required. A fluorine resin layer is suitably used as a material for the surface layer. Resins listed below may be used alone or in combination thereof as a fluorine resin.

A tetrafluoroethylene-perfluoro(alkylvinyl ether) copolymer (PFA), polytetrafluoroethylene (PTFE), a tetrafluoroethylene-hexafluoropropylene copolymer (FEP), an ethylene-tetrafluoroethylene copolymer (ETFE), polychlorotrifluoroethylene (PCTFE), an ethylene-chlorotrifluoroethylene copolymer (ECTFE), and polyvinylidene fluoride (PVDF).

Figure 3:
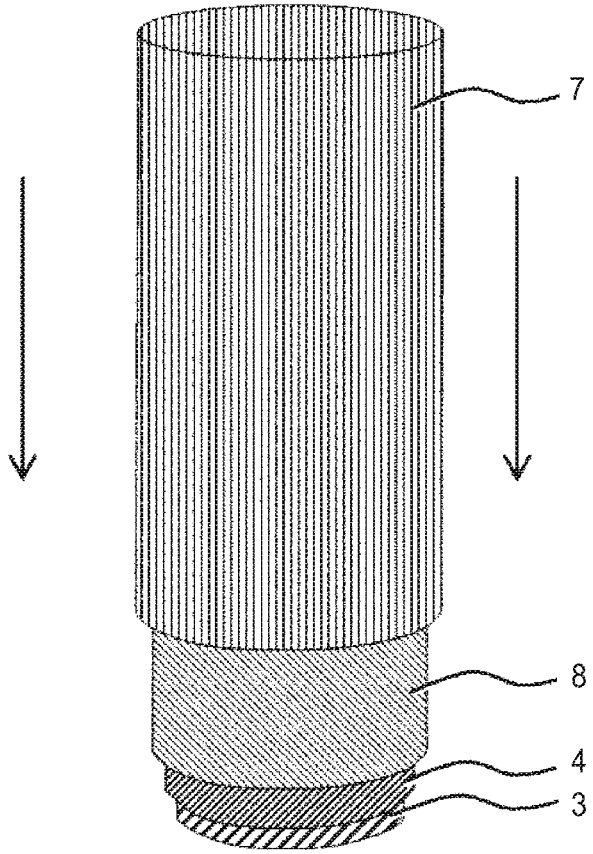
FIG. 3 is a schematic view for illustrating an example of a step of further laminating a fluorine resin surface layer on an elastic layer arranged on a base member.

Of the materials listed above, a PFA is preferred from the viewpoints of its moldability and toner releasability. Although a method of forming the surface layer is not particularly limited, the following methods may each be used:

a method involving covering the top of the elastic layer 4 with a fluorine resin tube 7, which has been obtained by molding a fluorine resin pellet into a tubular shape, via an adhesion layer 8 as illustrated in FIG. 3; and a method involving directly coating the surface of the elastic layer with fluorine resin fine particles or coating the surface of the elastic layer with a paint obtained by dispersing the fluorine resin fine particles in a solvent, and then drying the layer to bake the fine particles thereon.

In addition, the surface layer may contain a filler for the purpose of controlling its thermophysical properties to the extent that its moldability and releasability are not impaired. Examples of the filler include the following materials.

Silica, alumina, carbon, and carbon nanotubes.

The thickness of the surface layer is set to preferably 10 μm or more to 50 μm or less, more preferably 15 μm or more to 30 μm or less. When the thickness of the surface layer is 10 μm or more, its durability becomes satisfactory, and when the thickness is 30 μm or less, its heat transfer property becomes satisfactory.

The surface hardness of the fixing member is preferably 75° or more to 85° or less from the viewpoint of its followability to the unevenness of a recording material. The surface hardness may be measured with a microrubber hardness meter (product name: MICRORUBBER HARDNESS METER MD-1 capa TYPE C; manufactured by Kobunshi Keiki Co., Ltd.).

(Cured Product Layer)

The cured product layer arranged between the base member and the elastic layer is in contact with the outer peripheral surface of the base member and the inner peripheral surface of the elastic layer.

Such cured product layer is formed of a cured product of a material for forming the cured product layer containing an organopolysiloxane having a Si—H group and a silane coupling agent having a hydrolyzable functional group. The material for forming the cured product layer typically contains the following components (A) to (D), and contains the following component (E) and the following component (F) as optional components:

(A) an organopolysiloxane having a Si—H group;

(B) a silane coupling agent having an alkenyl group and a hydrolyzable functional group;

(C) another silane compound;

(D) a catalyst;

(E) a solvent; and (F) an additive.

The blending ratios of those components only need to be set so that a target cured product layer may be obtained, and hence the ratios are not particularly limited; known blending ratios may be selected and used.

The respective components are described in detail below.

(A) Organopolysiloxane Having Si—H Group

The organopolysiloxane having a Si—H group reacts with an alkenyl group in the elastic layer, such as a vinyl group, to provide an adhesive property. The organopolysiloxane may have a linear, branched, or cyclic form, and two or more kinds of organopolysiloxanes having different forms may be used in combination.

The organopolysiloxane having a Si—H group is not particularly limited as long as the above-mentioned target function can be obtained. Examples thereof include a methyl hydrogen polysiloxane, a dimethyl-methyl hydrogen polysiloxane, and a methyl hydrogen cyclopolysiloxane, and the molecular weight, and molar equivalent of the Si—H groups, thereof are appropriately selected from desired ranges.

(B) Silane Coupling Agent having Alkenyl Group and Hydrolyzable Functional Group Examples of the alkenyl group include a vinyl group and an allyl group. The alkenyl group reacts with a Si—H group of the organopolysiloxane serving as the component (A) to form a bond.

Examples of the hydrolyzable functional group include alkoxy groups each having 1 to 3 carbon atoms, such as a methoxy group, an ethoxy group, and a propoxy group. When an alkoxy group is hydrolyzed by, for example, moisture in air, a hydroxy group (—OH group) is produced from the alkoxy group. After that, the hydroxy group undergoes a condensation reaction mainly with a hydroxy group on the surface of the base member to be bonded to the surface, or the molecules of the silane coupling agent each having the hydroxy group are condensed with each other to be brought into an oligomer state.

Examples of the silane coupling agent having an alkenyl group include methacryloxypropyltrimethoxysilane and allyltrimethoxysilane.

(C) Other Silane Compound

A tetraalkoxysilane or the like may be added as a silane compound except the component (B). The tetraalkoxysilane has a hydrolyzable organic group, and as described in the foregoing, the molecules of the silane compound are condensed with each other, or the compound is condensed with a hydroxy group on the surface of the filler in the elastic layer. Specific examples of the tetraalkoxysilane include tetramethoxysilane, tetraethoxysilane, and tetrapropoxysilane.

(D) Catalyst

Examples of the catalyst may include (D-1) a condensation catalyst and (D-2) an addition curing catalyst. The condensation catalyst accelerates a condensation reaction (FIG. 2A) occurring between a hydroxy group, which is obtained by hydrolyzing a hydrolyzable functional group of the silane coupling agent or the other silane compound in the material for forming the cured product layer, and a hydroxy group on the surface of the base member.

Meanwhile, the addition curing catalyst accelerates a reaction (FIG. 2B) between the organopolysiloxane having a Si—H group and the silane coupling agent having an alkenyl group in the material for forming the cured product layer. Further, the addition curing catalyst accelerates an addition reaction (FIG. 2C) between a Si—H group in the cured product layer formed through the reaction of FIG. 2A and/or FIG. 2B, and an alkenyl group in the addition-curable silicone rubber forming the elastic layer at an interface between the elastic layer 4 and the cured product layer 6.

That is, an alkenyl group can be chemically bonded to the outer surface of the base member more efficiently by the action of the condensation catalyst. In addition, an alkenyl group fixed to the surface of the base member and a siloxane having a Si—H group can be efficiently caused to react with each other by the action of the addition curing catalyst. As a result, the amount of the organopolysiloxane having an unreacted Si—H group in the cured product layer can be reduced.

As described in the foregoing, when the condensation catalyst and the addition curing catalyst are caused to coexist in the material for forming the cured product layer, a reduction in catalytic activity of the condensation catalyst is of concern, and hence the addition curing catalyst is not typically used. According to our investigation, however, even in the case where the condensation catalyst and the addition curing catalyst are caused to coexist, when the mixture is used immediately after its preparation, the catalytic activity of the condensation catalyst is substantially free from reducing.

(D-1) Condensation Catalyst

The condensation catalyst is, for example, a tin compound. The tin compound serves to accelerate a condensation reaction between the cured product layer and the base member to improve an adhesive property therebetween. Examples of the tin compound include dibutyltin dilaurate and dioctyltin dilaurate. The condensation catalysts may be used alone or in combination thereof.

(D-2) Addition Curing Catalyst

The addition curing catalyst is, for example, a platinum compound. The platinum compound serves to accelerate an addition reaction between the elastic layer and the cured product layer to improve an adhesive property therebetween. Examples of the platinum compound include platinum complex compounds, such as chloroplatinic acid, a complex compound of divinyltetramethyldisiloxane and platinum, and a complex compound of carbonyl cyclovinylmethylsiloxane and platinum. The addition curing catalysts may be used alone or in combination thereof.

(E) Solvent

The solvent is, for example, an organic solvent. An organic solvent that has satisfactory wettability to the base member, that may be utilized in the preparation of the material for forming the cured product layer, and that easily volatilizes at the time of the drying of the layer of the material for forming the cured product layer is preferred. Specific examples of the organic solvent for the above-mentioned materials for the base member include n-heptane, n-hexane, toluene, and ethyl acetate.

(F) Additive

The additive may be added so that the layer of the material for forming the cured product layer may be visualized to enable visual observation of the surface of the layer. Examples of the additive include pigments, such as iron oxide.

(Method of forming Cured product Layer)

The cured product layer formed of the cured product of the material for forming the cured product layer may be formed by: applying the material for forming the cured product layer to the base member; and heating the resultant layer to bake the layer thereon.

Although a method of applying the material for forming the cured product layer to the base member is not particularly limited, a method enabling the formation of the layer of the material for forming the cured product layer having a uniform thickness is preferred.

Specific examples thereof include a method described in Japanese Patent No. 6066011 and dipping.

The layer of the material for forming the cured product layer is preferably baked at a temperature of 130° C. or more to 200° C. or less. When the baking temperature is 130° C. or more, a reaction between the organopolysiloxane having a Si—H group and the silane coupling agent having an alkenyl group easily advances, and when the baking temperature is 200° C. or less, an alkenyl group is hardly deactivated, and hence the alkenyl group is sufficiently caused to remain in the layer with ease.

In addition, the baking time of the layer of the material for forming the cured product layer is preferably 30 seconds or more to 60 minutes or less, particularly preferably 2 minutes or more to 15 minutes or less. When the baking time falls within the range, a condensation reaction between the molecules of the silane coupling agent can be sufficiently performed. In addition, the disappearance of an alkenyl group along with the baking can be suppressed.

The amount of the material for forming the cured product layer to be applied to the surface of the base member is preferably 0.1 mg/cm$^2$ or more to 10 mg/cm$^2$ or less, more preferably 0.5 mg/cm$^2$ or more to 1.0 mg/cm$^2$ or less from the viewpoint that a more satisfactory adhesive property between the layer and the base member, and a more satisfactory heat transfer property therebetween are obtained.

(Method of confirming Cured product Layer)

Analysis based on pyrolysis GC-MS may be used in the confirmation of the cured product layer arranged on the base member. The combination of Trace GC Ultra (product name; manufactured by Thermo Fisher Scientific) serving as a device for gas chromatography (GC), ISQ-LT (product name; manufactured by Thermo Fisher Scientific) serving as a device for mass spectrometry (MS), and PY-3030D (product name; manufactured by Frontier Laboratories Ltd.) serving as a pyrolyzer was used as an apparatus for the analysis. A piece of the cured product layer obtained as follows was used as a sample for the analysis: the surface layer and the elastic layer were cut and removed from the fixing member with a cutter or the like so that only the base member and the cured product layer were left; and the cured product layer of a size measuring about 0.2 mm by about 1.0 mm was cut out of the residue with a pair of scissors or the like. The analysis using pyrolysis GC-MS is performed by loading the sample into a sample holder.

The sample is heated under the conditions of, for example, 600° C. and 0.2 minute. The organopolysiloxane having a Si—H group, which remains unreacted in the cured product layer, and the silane coupling agent having an alkenyl group are detected by MS at the time of the heating.

(Peel Strength and Peeling Mode in Peel Test)

The base member and the elastic layer are satisfactorily bonded to each other, and the elastic layer causes a cohesive failure in "Adhesives-Determination of Peel Strength of Bonded Assemblies" (JIS-K6854-1:1999) specified in Japanese Industrial Standards.

In addition, a peel adhesive strength between the base member and the elastic layer may be determined by a peel test in JIS-K6854-1:1999 described above, and in at least one embodiment of the present disclosure, the peel adhesive strength between the base member and the elastic layer is set to 3.0 N/cm or more to 20.0 N/cm or less.

A specific test method is described in Example 1 to be described later.

(Fixing Device)

Figure 5:
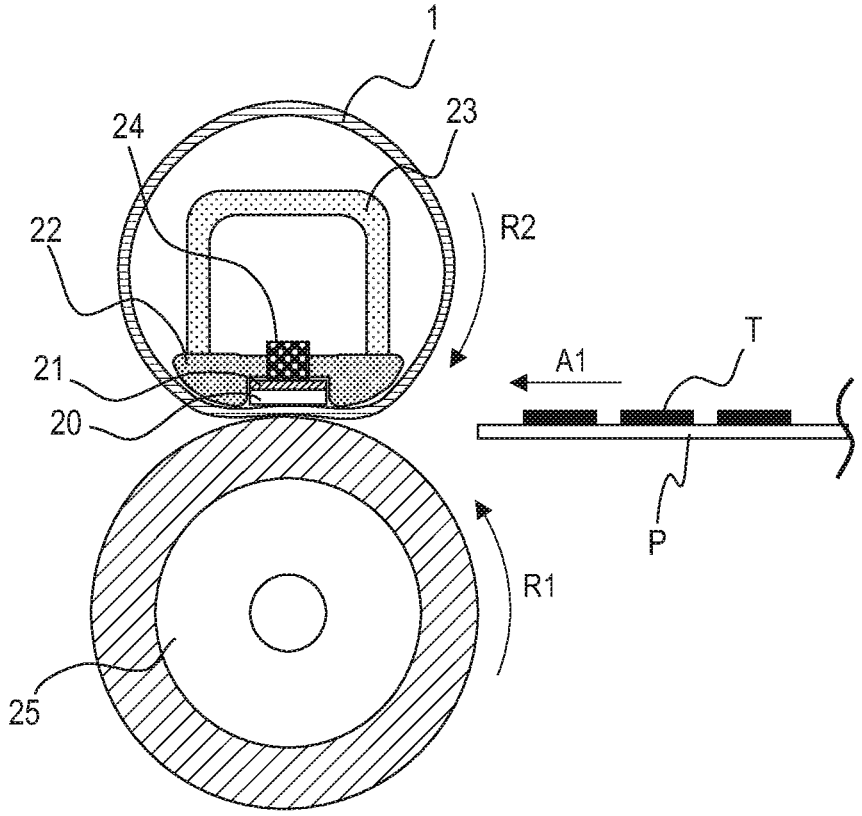
FIG. 5 is a schematic sectional view for illustrating an example of a fixing device for an unfixed toner image.

The electrophotographic member according to at least one embodiment of the present disclosure may be utilized for the fixing member of a fixing device including a fixing member and a pressure member, the fixing device being configured to heat a recording material having an unfixed toner image in a nip portion formed by the fixing member and the pressure member to fix the unfixed toner image to the recording material An example of a fixing device using the electrophotographic member in the form of a fixing belt illustrated in FIG. 1A is illustrated in FIG. 5.

FIG. 5 is a schematic sectional view of an example of a fixing device mounted with a fixing belt in a direction perpendicular to the rotation axis of the fixing belt.

The fixing device includes the fixing belt 1 serving as a fixing member and a pressure roller 25 serving as a pressure member. The fixing belt 1 and the pressure roller 25 form a nip portion.

A heater 20 for heating the fixing belt 1 through non-radiant heating, a heat transfer member 21, a heater holder 22 configured to hold the heater 20 and the heat transfer member 21, a temperature-detecting element 24, and a stay 23 for pressurization configured to support the heater holder 22 are arranged in the fixing belt 1. Herein, the heater 20 is, for example, a ceramic heater. A pressure spring (not shown) is arranged between each of both ends in the width direction of the stay 23 for pressurization and an unshown spring-receiving portion on a fixing device main body side, and hence the stay 23 for pressurization is pressed against the pressure roller 25. Accordingly, in the nip portion, the heater 20 is arranged so as to sandwich the fixing belt 1 together with the pressure roller 25.

The fixing belt 1 is loosely fit onto the members arranged therein. In addition, the stay 23 is fit into a flange portion (not shown) to be fixedly arranged.

The heater holder 22 is a holding member configured to fix and hold the heater 20. A temperature detected by the temperature-detecting element 24 is utilized to control the temperature of the nip portion.

The fixing belt 1 rotates in a direction indicated by an arrow R2 following the rotary driving of the pressure roller 25 in a direction indicated by an arrow R1. The inner peripheral surface of the fixing belt 1 rotates while being rubbed with the heater 20 and the heater holder 22, and the nip portion is heated by the heater 20 through the fixing belt 1. A recording material P having unfixed electrophotographic toner images T formed by an electrophotographic method is conveyed from a direction indicated by an arrow A1 into the nip portion. The recording material P is sandwiched between the peripheral surfaces of the fixing belt 1 and the pressure roller 25 in the nip portion, and is then conveyed. In the process, the recording material P is heated under pressure, and hence the unfixed toner images T are fixed to the recording material P.

When the fixing roller illustrated in FIG. 1B is used as the fixing member of the fixing device, the fixing roller is arranged instead of the portion including the fixing belt 1 illustrated in FIG. 5 to form a nip portion for fixing unfixed toner between itself and the pressure roller. The nip portion may be heated by a heating device arranged in at least one of the fixing roller or the pressure roller, or arranged outside these rollers.

According to at least one embodiment of the present disclosure, the electrophotographic member in which the elastic layer hardly breaks even when the fixation of an electrophotographic image to a thick recording material is repeatedly performed can be obtained. In addition, according to at least one embodiment of the present disclosure, the fixing device that can form a high-quality electrophotographic image can be obtained.

EXAMPLES

The present disclosure is more specifically described below by way of Examples. Production conditions for fixing belts produced in Examples and Comparative Examples are shown in Table 1.

Example 1

<Production of Fixing Belt>

First, an endless sleeve made of electroformed nickel having an inner diameter of 30 mm, a width of 400 mm, and a thickness of 40 μm was prepared as a base member. In the following series of production processes, the endless sleeve was handled while a core was inserted therein.

As a stage before the performance of a primer treatment, a primer liquid (I) was prepared by an ordinary method through the use of the following respective components.

Composition of Primer Liquid (I):

| | |
|---|---|
| Component (A): | |
| Methylhydrogencyclopolysiloxane: | 4.0 parts by mass |
| Component (B): | |
| Methacryloxypropyltrimethoxysilane: | 2.5 parts by mass |
| Component (C): | |
| Tetraethoxysilane: | 2.5 parts by mass |
| Component (D-1): | |
| Tin compound (product name: SND3260; Gelest, Inc.): | 0.02 part by mass |
| Component (D-2): | |
| Platinum compound solution (product name: SIP6829.2; Gelest, Inc.): | 0.01 part by mass |
| Component (E): | |
| Heptane: | 47.5 parts by mass |
| Ethyl acetate: | 31 parts by mass |
| Toluene: | 7.5 parts by mass |

Next, the outer peripheral surface of the base member was subjected to a primer treatment immediately after the preparation. Specifically, the primer liquid (I) was applied in an application amount of 0.7 mg/cm$^2$ to the outer peripheral surface, and the coat was baked by being heated in an oven heated to a temperature of 165° C. for 4 minutes. Thus, a cured product layer was formed. A method described in Japanese Patent No. 6066011 was used in the application of the primer liquid (I).

An addition-curable silicone rubber composition was prepared as described below.

A vinylated polydimethylsiloxane having at least two vinyl groups in a molecule thereof (product name: DMS-V41, manufactured by Gelest, Inc., number-average molecular weight: 68,000 (in terms of polystyrene), molar equivalent of vinyl groups: 0.04 mmol/g) was prepared as the organopolysiloxane having an alkenyl group serving as the component (a).

In addition, a methyl hydrogen polysiloxane having at least two Si—H groups in a molecule thereof (product name: HMS-301, manufactured by Gelest, Inc., number-average molecular weight: 1,300 (in terms of polystyrene), molar equivalent of Si—H groups: 3.60 mmol/g) was prepared as the organopolysiloxane having a Si—H group serving as the component (b). 0.5 Part by mass of the component (b) was added to 100 parts by mass of the component (a), and the components were sufficiently mixed to provide an addition-curable silicone rubber stock solution. The ratio (H/Vi) of the number of Si—H groups to the number of vinyl groups in the silicone rubber stock solution was 0.45.

Further, a catalytic amount of an addition curing catalyst (platinum catalyst: platinum carbonyl cyclovinylmethylsiloxane complex) and a trace amount of an inhibitor were added to the stock solution, and the materials were sufficiently mixed.

High-purity and true-spherical alumina (product name: ALUNABEADS CB-A10S; manufactured by Showa Titanium Co., Ltd.) was blended and kneaded as a filler into the addition-curable silicone rubber stock solution at a volume ratio of 45% with respect to an elastic layer. Thus, an addition-curable silicone rubber composition having a durometer hardness in conformity with JIS K 6253A after curing of 10° was obtained.

The liquid addition-curable silicone rubber composition prepared in advance was applied to the primer-treated outer peripheral surface of the base member prepared in advance by a ring coating method so as to have a thickness of 300 μm. The member thus obtained, which included the cured product layer and the coat of the liquid addition-curable silicone rubber composition on the outer peripheral surface of the base member, was heated in an electric furnace set to 200° C. for 4 hours so that the addition-curable silicone rubber composition was cured. Thus, the elastic layer was obtained.

After that, an addition-curable silicone rubber adhesive (obtained by mixing equal amounts of the "liquid A" and "liquid B" of a product available under the product name "SE1819CV" from Dow Corning Toray Co., Ltd.) was applied to the surface of the elastic layer so as to have a thickness of about 50 Thus, an adhesive layer was formed.

Next, as illustrated in FIG. 3, the adhesive layer was covered with a fluorine resin tube having an inner diameter of 29 mm and a thickness of 30 μm (product name: KURA-FLON-LT; manufactured by Kurabo Industries Ltd.). The member obtained by covering the adhesive layer with the fluorine resin tube as described above was heated in an electric furnace set to 200° C. for 1 hour so that the adhesive layer was cured to fix the fluorine resin tube as a surface layer on the elastic layer. Both end portions of the resultant member were cut. Thus, a fixing belt having a width of 341 mm was obtained.

(Evaluation of Fixing Belt)

The fixing belt was evaluated for the following respective items. The obtained results are shown in Table 1, and Table 2.

(Evaluation 1; H/Vi Value of Elastic Layer)

An abundance ratio between a vinyl group and a Si—H group in a silicone compound may be determined by performing hydrogen nucleus measurement (H-NMR) involving using a nuclear magnetic resonance apparatus (NMR). A peak derived from a vinyl group is detected in the chemical shift range of from 5.6 ppm to 6.2 ppm, and hence its integrated value is defined as the amount of a hydrogen nucleus derived from a vinyl group. In addition, a peak derived from a Si—H group is similarly detected in the chemical shift range of from 4.6 ppm to 4.7 ppm, and hence its integrated value is defined as the amount of a hydrogen nucleus derived from a Si—H group. A vinyl group has three hydrogen atoms on its structure, and hence an H/Vi value may be calculated by using a numerical value, which is obtained by dividing the integrated value derived from a vinyl group by 3, as a denominator and the integrated value derived from a Si—H group as a numerator. In this example, the addition-curable silicone rubber stock solution having an H/Vi value of 0.45 is used in the elastic layer.

(Evaluation 2; Peel Test)

Figure 4:
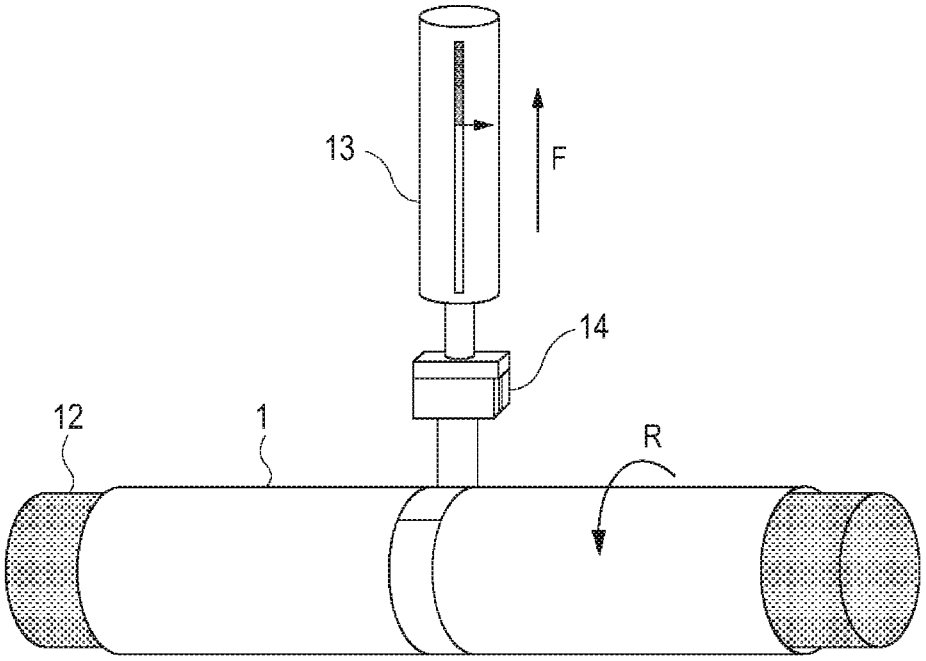
FIG. 4 is a schematic view for describing a peel test method for the evaluation of the adhesive force of the elastic layer to the base member.

A method for the peel test of the elastic layer from the base member of the fixing belt is described with reference to FIG. 4.

A core 12 is inserted into the base member of the fixing belt 1 for a peel test as required so that the shape of the base member may not change, and a slit having a width of 1 cm is made with a razor along the peripheral direction of the fixing belt serving as a fixing member from its surface layer side so as to reach the surface of the base member. Next, a notch is made at one site in the longitudinal direction of the portion having made therein the slit, and the site is defined as a peeling end. At the peeling end, a razor is inserted into an interface portion between the elastic layer and the base member to forcibly peel the elastic layer by about 2 cm in the peripheral direction of the fixing belt at the interface. Then, the peeling end is interposed in a chuck portion 14 of a force gauge 13. When the elastic layer is thin, and is hence liable to cause a plastic deformation, the following procedure may be adopted: a polyimide tape is bonded as a reinforcing material to the surface of the surface layer prior to the formation of the slit, and the slit is formed from above the tape.

Then, the core 12 is fixed so that the fixing belt can freely rotate in its peripheral direction, and the force gauge 13 is lifted with an unshown unit in a direction perpendicular to the tangential direction of the main body of the fixing belt at the root of the peeling end at a constant speed of 50 mm/min until the length of the peeled layer on the elastic layer side reaches 10 mm. At this time, it is important that a direction F in which the elastic layer is peeled maintain an angle of 90° with respect to the tangential direction of the main body of the fixing belt at the root of the peeling end. In order that an angle of 90° may be maintained, first, when the peeling end is interposed in the force gauge, the interposition is performed so that the peeled layer on the elastic layer side may form an angle of 90° with respect to the tangential direction. Next, the peeling end is pulled from directly above the rotation axis of the core 12 in the perpendicular direction F at a constant moving speed (50 mm/min), and at the same time, the core 12 is rotated in an R direction in the figure so that the moving speed of the peeling end along the tangent of the core 12 may be equal to the moving speed thereof in the perpendicular direction F. Specifically, in the case where the outer diameter of the fixing belt is φ30 mm, when the core is rotated at a speed of 0.53 rpm, the elastic layer can be peeled while an angle of 90° is maintained.

When the fixing member is a fixing roller, the fixing roller is fixed by using the base member of the fixing roller instead of the core 12, and a peel test is performed by the above-mentioned operation.

The failure pattern of a broken surface formed by the peel test is judged based on "Adhesives-Designation of Main Failure Patterns" (JIS K6866:1999) specified in Japanese Industrial Standards. Specifically, the failure pattern is identified in accordance with the following criteria.

Adhesive failure: The failure of adhesive bonding in which the presence of a crack at an interface between an adhesive and an adherent is visually observable.

Cohesive failure: The failure of a bonded sediment in which the presence of a crack in an adhesive or an adherent is visually observable.

When the base member and the elastic layer are satisfactorily bonded to each other, the elastic layer shows a cohesive failure on the broken surface. The state is a state in which the elastic layer that has failed adheres to both of the base member side and the elastic layer side. When the broken surface shows a mixed failure of a cohesive failure and an adhesive failure, a case in which the cohesive failure portion of the elastic layer accounts for 50% or more of the peeled area of the layer is judged to be the cohesive failure of the elastic layer, and a case in which the cohesive failure portion accounts for less than 50% of the peeled area is judged to be the adhesive failure of the layer.

The results of the peeling modes obtained in the peel test were classified as described below.

Rank A: Cohesive failure

Rank B: Adhesive failure

In addition, a tensile force at the time of the peeling of the elastic layer from the base member was measured with the force gauge 13, and was defined as a peel adhesive strength representing the strength of the elastic layer.

(Evaluation 3; Measurement of Universal Hardnesses (HU1, HU2) of Fixing Belt)

A razor was used to forcibly peel the cured product layer on the base member of the fixing belt and the elastic layer thereof from each other, and to forcibly peel the adhesive layer on the surface layer side thereof and the elastic layer from each other. Part of the elastic layer having an outer surface on the surface layer side and an inner surface on the base member side thus obtained was cut into a piece of a size that could be utilized for measurement. Thus, a measurement sample was obtained.

A position reached by cutting the measurement sample from the outer surface in its depth direction by 10 μm and the inner surface of the elastic layer were defined as measurement portions, and the universal hardnesses of the elastic layer in its thickness direction were measured in the measurement portions.

The measurement was performed with an ultramicrohardness meter (product name: FISCHERSCOPE HM2000 XYp; manufactured by Fischer Instruments K.K.) by the following procedure.

A quadrangular pyramid diamond Vickers indenter having a face angle of 136° in conformity with ISO 14577 is used in the measuring head of the measuring apparatus, and the indenter is indented into the surface of a measurement portion of the sample. Specifically, the indenter is indented from the surface of the measurement portion of the sample at an indentation speed of 3 μm/sec to a depth of 30 μm. Then, the indenter is held for 5 seconds under a state of being indented, and unloading is performed at 3 μm/sec. A universal hardness (HU) is calculated in accordance with the following equation (1). In the following equation (1), "h" represents an indentation depth, F(h) represents an applied load at the indentation depth "h", and A(h) represents the area of contact between the indenter and the sample at the indentation depth "h", and is represented by the equation (2) in the case of a Vickers indenter.

$$HU=F(h)/A(h) \quad \text{Equation (1)}$$

$$A(h)=26.43\times h^2 \quad \text{Equation (2):}$$

A universal hardness (HU1) at the position reached by cutting the measurement sample from the outer surface in the depth direction by 10 μm and a universal hardness (HU2) on the inner surface of the elastic layer thus obtained were used to determine a ratio (HU2/HU1) between these hardnesses.

(Evaluation 4; Thick Paper-Passing Test of Fixing Belt)

The fixing belt was mounted on a color multifunction peripheral (product name: imageRUNNER ADVANCE 5051; manufactured by Canon Inc.), and a continuous paper-passing test was performed by using thick paper (product name: THICKEST PAPER FOR CLC5000 (basis weight: 250 g/mm$^2$); manufactured by Canon Inc.) as a recording material, followed by the evaluation of the presence or absence of the occurrence of breakage in the elastic layer of the fixing belt based on the following criteria.

Rank A: The elastic layer did not break during the continuous passing of 150,000 sheets of the thick paper.

Rank B: The elastic layer did not break during the continuous passing of 100,000 sheets of the thick paper, but broke during the continuous passing of more than 100,000 sheets of the thick paper.

Rank C: The elastic layer broke or the elastic layer peeled from the base member by the time when 100,000 sheets of the thick paper were continuously passed.

Examples 2 to 7 and Comparative Examples 1 to 10

Fixing belts were each produced in the same manner as in Example 1 except that the kind of the primer liquid, the catalysts to be added, the thickness of the elastic layer, the H/Vi of the elastic layer, and the amount of the filler were changed as shown in Table 1, and each of the resultant fixing belts was evaluated. Production conditions for the respective fixing belts and the evaluation results of the belts are shown in Table 1. The H/Vi of the elastic layer is changed by adjusting the blending amount of the component (b) with respect to the blending amount of the component (a) (when H/Vi=0.35, the blending amount of the component (b) is 0.78 part by mass, and when H/Vi=1.0, the blending amount of the component (b) is 2.22 parts by mass).

In Comparative Example 2, the fixing belt was produced by directly arranging the elastic layer on the base member without forming any cured product layer.

In Comparative Example 3, a primer liquid (II) was prepared in the same manner as in Example 1 by using the following respective components, and was used in the formation of a cured product layer.

Composition of Primer Liquid (II)

| | |
|---|---|
| Component (B): | |
| Allyltrimethoxysilane | 2.5 parts by mass |
| Component (D-1): | |
| Tin compound (product name: SND3260; Gelest, Inc.) | 0.01 part by mass |
| Component (E): | |
| Heptane | 90 parts by mass |
| Toluene | 1.2 parts by mass |

In Comparative Example 4, a primer liquid (III) was prepared in the same manner as in Example 1 by using the following respective components, and was used in the formation of a cured product layer.

Composition of Primer Liquid (III)

| | |
|---|---|
| Component (C): | |
| Tetrapropyl orthosilicate | 2.5 parts by mass |
| Component (D-1): | |
| Tin compound (product name: SND3260; Gelest, Inc.) | 0.01 part by mass |
| Component (E): | |
| Heptane | 80 parts by mass |
| Toluene | 1.2 parts by mass |

The results of the evaluation 1 to evaluation 4 of the fixing members according to Example 1 to Example 7 and Comparative Example 1 to Comparative Example 3 are shown in Table 2.

TABLE 1

| | | Cured product layer | | | | Elastic layer | | |
|---|---|---|---|---|---|---|---|---|
| | | Kind of material for forming cured product layer | Component in material for forming cured product layer: Component (A) to component (C) | Component in material for forming cured product layer: Catalyst | Component in material for forming cured product layer: Application amount (mg/cm$^3$) | Elastic layer thickness (μm) | Evaluation 1 H/Vi | Filler amount (vol %) |
| Example | 1 | (I) | (A), (B), and (C) | D-1 and D-2 | 0.7 | 300 | 0.45 | 45 |
| | 2 | (I) | (A), (B), and (C) | D-1 and D-2 | 0.7 | 500 | 1.00 | 35 |
| | 3 | (I) | (A), (B), and (C) | D-1 and D-2 | 0.7 | 300 | 0.35 | 45 |
| | 4 | (I) | (A), (B), and (C) | D-1 and D-2 | 0.7 | 100 | 0.35 | 45 |
| | 5 | (I) | (A), (B), and (C) | D-1 and D-2 | 0.7 | 500 | 0.45 | 45 |
| | 6 | (I) | (A), (B), and (C) | D-1 and D-2 | 1.0 | 300 | 0.45 | 45 |
| | 7 | (I) | (A), (B), and (C) | D-1 and D-2 | 0.5 | 300 | 0.45 | 45 |
| Comparative Example | 1 | (I) | (A), (B), and (C) | — | 0.7 | 300 | 0.45 | 45 |
| | 2 | — | — | — | 0 | 300 | 0.45 | 45 |
| | 3 | (II) | (B) | D-1 | 0.7 | 300 | 0.45 | 45 |
| | 4 | (III) | (C) | D-1 | 0.7 | 300 | 0.45 | 45 |
| | 5 | (I) | (A), (B), and (C) | — | 0.7 | 500 | 1.00 | 35 |
| | 6 | (I) | (A), (B), and (C) | — | 0.7 | 300 | 0.35 | 45 |
| | 7 | (I) | (A), (B), and (C) | — | 0.7 | 100 | 0.45 | 45 |
| | 8 | (I) | (A), (B), and (C) | — | 0.7 | 500 | 0.45 | 45 |
| | 9 | (I) | (A), (B), and (C) | — | 1.0 | 300 | 0.45 | 45 |
| | 10 | (I) | (A), (B), and (C) | — | 0.5 | 300 | 0.45 | 45 |

TABLE 2

| | | Evaluation result | | | |
|---|---|---|---|---|---|
| | | Evaluation 2 | | | Evaluation 4 |
| | | Peel adhesive strength (N/cm) | Peeling mode at the time of peel test Rank | Evaluation 3 HU2/HU1 | Thick paper-passing test evaluation rank |
| Example | 1 | 12.0 | A | 1.3 | A |
| | 2 | 9.7 | A | 1.1 | A |
| | 3 | 10.1 | A | 1.3 | A |
| | 4 | 10.9 | A | 1.3 | A |
| | 5 | 11.5 | A | 1.2 | A |
| | 6 | 14.3 | A | 1.4 | B |
| | 7 | 10.4 | A | 1.2 | A |
| Comparative Example | 1 | 11.1 | A | 1.6 | C |
| | 2 | 1.1 | B | 1.0 | — |
| | 3 | 8.8 | A | 1.1 | C |
| | 4 | 7.5 | A | 1.0 | C |
| | 5 | 8.9 | A | 1.6 | C |
| | 6 | 12.7 | A | 1.8 | C |
| | 7 | 11.5 | A | 1.7 | C |
| | 8 | 10.3 | A | 1.5 | C |
| | 9 | 13.3 | A | 2.0 | C |
| | 10 | 9.2 | A | 1.5 | C |

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2018-192013, filed Oct. 10, 2018, and Japanese Patent Application No. 2019-170309, filed Sep. 19, 2019, which are hereby incorporated by reference herein in their entirety.

What is claimed is:

1. An electrophotographic member comprising:

a base member;

a cured product layer; and an elastic layer, in this order, the elastic layer having a thickness of 100 μm or more to 500 μm or less, and containing a cured product of an addition-curable silicone rubber composition, the cured product layer being in contact with the base member and an inner surface of the elastic layer, the cured product layer containing a cured product of a composition containing an organopolysiloxane having a Si—H group and a silane coupling agent having an alkenyl group, wherein a peel adhesive strength between the elastic layer and the base member is 3.0 N/cm or more to 20.0 N/cm or less, wherein the elastic layer undergoes a cohesive failure in a peel test from the base member, and wherein, when a universal hardness of the elastic layer in a thickness direction thereof measured at a position reached by cutting the elastic layer from an outer surface thereof in the thickness direction thereof by 10 μm is represented by HU1, and a universal hardness of the elastic layer in the thickness direction measured on the inner surface of the elastic layer is represented by HU2, a ratio HU2/HU1 is 1.0 or more to 1.4 or less.

2. The electrophotographic member according to claim 1, wherein the ratio HU2/HU1 is 1.0 or more to 1.3 or less.

3. The electrophotographic member according to claim 1, wherein a material for forming the cured product in the cured product layer contains at least one of a condensation catalyst or an addition curing catalyst as a catalyst.

4. The electrophotographic member according to claim 3, wherein the condensation catalyst comprises a tin compound.

5. The electrophotographic member according to claim 3, wherein the addition curing catalyst comprises a platinum compound.

6. The electrophotographic member according to claim 1, wherein the electrophotographic member is a film-shaped member of a fixing device configured to fix an unfixed toner image on a recording material through use of the film-shaped member heated through non-radiant heating.

7. The electrophotographic member according to claim 1, wherein the base member has a cylindrical outer peripheral surface, and wherein the cured product layer and the elastic layer are on the outer peripheral surface of the base member.

8. The electrophotographic member according to claim 7, wherein the electrophotographic member has an endless belt shape, or a roller shape.

9. A fixing device comprising:

a fixing member; and a pressure member, the fixing device being configured to heat a recording material having an unfixed toner image in a nip portion formed by the fixing member and the pressure member to fix the unfixed toner image to the recording material, wherein the fixing member includes:

a base member;

a cured product layer; and an elastic layer, in this order, the elastic layer having a thickness of 100 μm or more to 500 μm or less, and containing a cured product of an addition-curable silicone rubber composition, the cured product layer being in contact with the base member and an inner surface of the elastic layer, the cured product layer containing a cured product of a composition containing an organopolysiloxane having a Si—H group and a silane coupling agent having an alkenyl group, wherein a peel adhesive strength between the elastic layer and the base member is 3.0 N/cm or more to 20.0 N/cm or less, wherein the elastic layer undergoes a cohesive failure in a peel test from the base member, and wherein, when a universal hardness of the elastic layer in a thickness direction thereof measured at a position reached by cutting the elastic layer from an outer surface thereof in the thickness direction thereof by 10 μm is represented by HU1, and a universal hardness of the elastic layer in the thickness direction measured on the inner surface of the elastic layer is represented by HU2, a ratio HU2/HU1 is 1.0 or more to 1.4 or less.

10. The fixing device according to claim 9, further comprising a heater configured to heat the fixing member through non-radiant heating.

11. A fixing device comprising:

a fixing member having one of an endless belt shape and a roller shape;

a pressure member; and a heater configured to heat the fixing member through non-radiant heating, the fixing device being configured to heat a recording material having an unfixed toner image in a nip portion formed by the fixing member and the pressure member to fix the unfixed toner image to the recording material, wherein the fixing member includes:

a base member;

a cured product layer; and an elastic layer, in this order, the elastic layer having a thickness of 100 μm or more to 500 μm or less, and containing a cured product of an addition-curable silicone rubber composition, the cured product layer being in contact with the base member and an inner surface of the elastic layer, the cured product layer containing a cured product of a composition containing an organopolysiloxane having a Si—H group and a silane coupling agent having an alkenyl group, wherein a peel adhesive strength between the elastic layer and the base member is 3.0 N/cm or more to 20.0 N/cm or less, wherein the elastic layer undergoes a cohesive failure in a peel test from the base member, wherein, when a universal hardness of the elastic layer in a thickness direction thereof measured at a position reached by cutting the elastic layer from an outer surface thereof in the thickness direction thereof by 10 μm is represented by HU1, and a universal hardness of the elastic layer in the thickness direction measured on the inner surface of the elastic layer is represented by HU2, a ratio HU2/HU1 is 1.0 or more to 1.4 or less, wherein the base member has a cylindrical outer peripheral surface, and the cured product layer and the elastic layer are on the outer peripheral surface of the base member, and wherein at least part of the heater is arranged so as to be in contact with an inner peripheral surface of the fixing member.

12. The fixing device according to claim 11, wherein the heater is arranged in the nip portion so as to sandwich the fixing member together with the pressure member.

* * * * *